US005878593A

United States Patent [19]

Lane et al.

[11] Patent Number: 5,878,593

[45] Date of Patent: Mar. 9, 1999

[54] COOL HOLDER AND DISPENSING DEVICE FOR SMALL CONTAINERS-SUCH AS CREAMER PACKETS AND THE LIKE

[76] Inventors: Benny R. Lane, 14937 Oaks North Dr., Addison, Tex. 75240; Charlotte A. Youngquist, 2024 Foxcroft La., Arlington, Tex. 76014

[21] Appl. No.: 873,383

[22] Filed: Jun. 11, 1997

[51] Int. Cl.[6] ..... F25D 3/08

[52] U.S. Cl. ..... 62/457.5; 165/183

[58] Field of Search ..... 62/457.5, 372; 165/183

[56] References Cited

U.S. PATENT DOCUMENTS

| | | | |
|---|---|---|---|
| 1,017,478 | 2/1912 | Stauf | 62/457.5 |
| 2,378,284 | 6/1945 | Burge | 221/123 |
| 2,653,850 | 9/1953 | Volten | 221/121 |
| 2,845,780 | 8/1958 | Conklin et al. | 280/79.3 |
| 3,179,289 | 4/1965 | Moyer et al. | 221/121 |
| 3,410,385 | 11/1968 | Freet et al. | 194/39 |
| 3,437,238 | 4/1969 | Luba | 221/129 |
| 3,605,435 | 9/1971 | Taylor | 62/457.5 |
| 4,767,022 | 8/1988 | Oldorf | 221/92 |
| 4,858,444 | 8/1989 | Scott | 62/457.5 |
| 5,189,892 | 3/1993 | Roberts | 62/372 |
| 5,368,191 | 11/1994 | Johnson | 221/194 |

*Primary Examiner*—William E. Tapolcai
*Attorney, Agent, or Firm*—Charles W. McHugh

[57] ABSTRACT

A portable apparatus for storing small packets of perishable material so as to extend the storage life of the material is provided. A base and housing fixed to the base are provided. A heat exchange device which includes a sealed container filled with a cooling medium is mounted inside the housing. A plurality of vertically oriented tubes that have open tops and bottoms are provided for holding a plurality of small packets of the perishable material in heat exchange relationship with the cooling medium. A cover is mounted over the housing and the stored perishable material therein to keep the packets of material below room temperature until such time as one of the packets is dispensed for use.

4 Claims, 4 Drawing Sheets

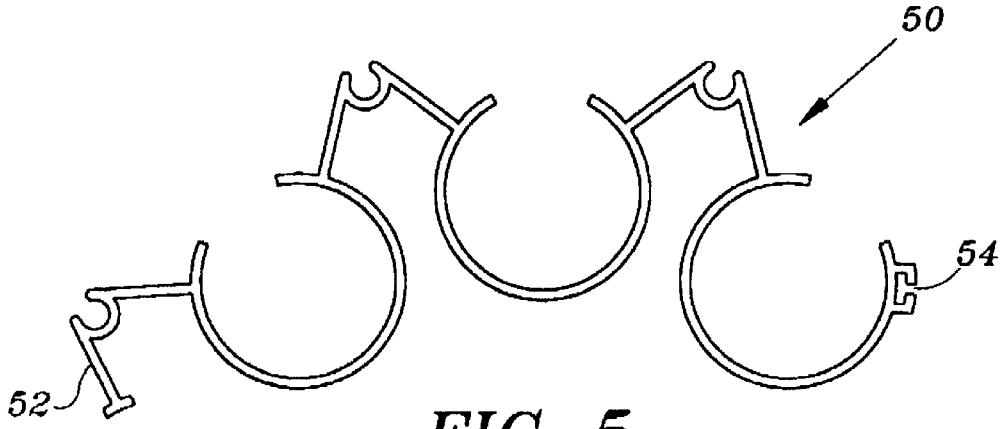
FIG. 5
FIG. 6
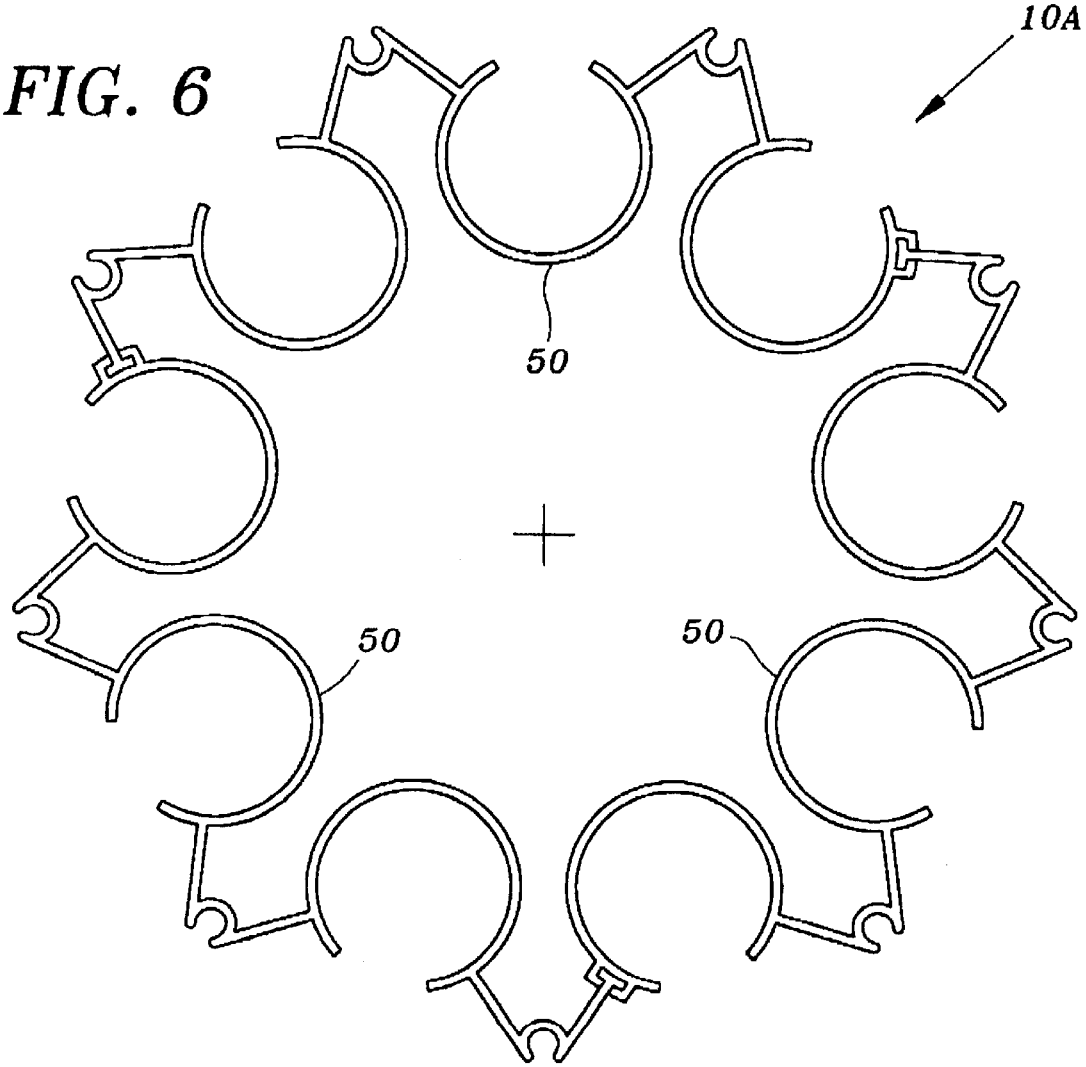

COOL HOLDER AND DISPENSING DEVICE FOR SMALL CONTAINERS-SUCH AS CREAMER PACKETS AND THE LIKE

CROSS-REFERENCE TO RELATED APPLICATION

This disclosure contains subject matter that was originally disclosed in provisional patent application Ser. No. 60/019,652 filed by the applicants on Jun. 11, 1996.

FIELD OF THE INVENTION

This invention relates generally to the temporary storage—at a relatively cool temperature—of a plurality of small containers, such as the cup-shaped packets that hold a small quantity of cream, butter, margarine, cream cheese, etc. The invention also relates to the orderly dispensing of such containers to consumers on a help-yourself basis. In one embodiment of the invention, an apparatus is used to provide cream (or an equivalent liquid) to a person who wants to use it in adjusting the taste of a cup of coffee or tea or the like. More specifically, the invention relates to a sanitary way of dispensing a single small container in such a way that other stored containers are effectively isolated from the one that is being withdrawn by a consumer. The invention also relates to the storage of small containers in a way that they may be kept cold, or at least very cool—without being held in an electrically connected refrigeration unit.

BACKGROUND OF THE INVENTION

It is well known that persons who drink hot beverages such as coffee and tea often like to alter the natural taste of their beverages by adding small quantities of cream and/or sugar (or their equivalents). When the beverages are to be dispensed on a self-serve basis, it is common to place small containers of cream and sugar next to an urn or pot or similar storage/dispensing for the beverage. Making small quantities of sugar or artificial sweeteners available to suit the individual tastes of a given person has not been a vexing problem, because sugar and artificial sweeteners can be safely stored at room temperature for a very long time. So, as long as empty containers are periodically picked up and discarded, there is essentially no difficulty in meeting the wishes of those who want to sweeten their coffee or tea. However, a dairy product—like cream—usually needs to be kept cold, or at least cool, in order to extend its "shelf" life, until it is consumed. (If cream is left at room temperature for an extended period of time, it can spoil, i.e., curdle, and lose its sweet taste.) In a cafeteria or the like, the quantity of cream that is consumed in a very few hours may justify a refrigerated holder/dispenser for cream, milk, or the product that is commonly known as half-and-half. But at a convenience store or sandwich shop, there may not be enough consumption of cream to justify a refrigerated holder/dispenser. Instead, relatively small containers of cream and the like are often placed at the serving area, where customers can help themselves to one or more containers after they have obtained their hot beverage.

To keep the contents of small containers reasonably fresh, it is a common practice to store a dozen or so containers in a shallow bath of ice and water (in an open-top bowl or tray). This technique may be serviceable for extending the shelf life of cream and the like, but it is really not very sanitary—because anyone who has germs on his or her hand will soon contaminate the entire bath during the act of reaching for a first container. A second person who reaches into the bath for a container of cream will then run the risk of coming into contact with whatever may have been introduced into the bath by the first person's dirty hands. And even hands that appear to be free of dirt can be carriers of germs and/or bacteria that have been picked up in a public restroom or from a door handle or telephone handset.

Too, it is common for the self-serve areas in most restaurants to have what is commonly called a "sneeze guard," which is a relatively large piece of transparent glass or rigid plastic that is suspended over stored food in such a way that a customer can see the food behind the guard—but the customer cannot accidentally sneeze directly onto the food. But it seems that no one has tried to offer equivalent protection for the open-top trays that hold small containers of cream and a bath of ice and cold water. Hence, any given person in a serving line, even if he or she is not partaking of the stored cream containers, can sneeze onto the bath and spread germs in an unwholesome manner. Children especially are not likely to realize the consequences of sneezing in the direction of things on a food-service counter. It is an object, therefore, to provide a device for storing a plurality of small containers in such a way that they can be kept cool for an extended period of time, without the need for a tray of ice and cold water (which can be messy) and without the need for placing another refrigerated appliance where it is accessible to the public.

Another object is to provide a device that can hold cream containers where they are visible to the public but relatively immune to being contaminated by the random spread of germs—by a person handling them or sneezing on them, etc.

It is another object to discourage the waste of creamer packets—by discouraging customers from grabbing a handful of packets just because they are present and readily available, in what may be described as a bulk condition.

A further object is to promote the sale of a new flavor or brand of coffee (or tea) in a convenience store or cafeteria, by providing a new space to advertise the flavor/brand in the vicinity of the dispenser of that particular beverage.

These and other objects will be apparent from a careful study of the disclosure that follows, along with reference to the drawings provided herewith.

BRIEF DESCRIPTION OF THE SEVERAL FIGURES OF THE DRAWING

FIG. 5 is a top plan view of an extruded element that can be used to form one element of an alternative embodiment of the invention;

FIG. 6 is a top plan view of three of the elements shown in FIG. 5, arranged, edge to edge, to form a circle.

BRIEF DESCRIPTION OF THE INVENTION

Figure 1:
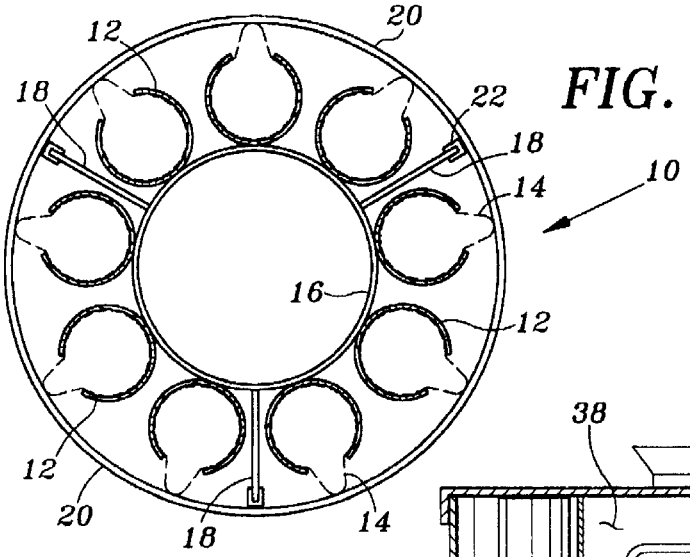
FIG. 1 is a top plan view of a holder/dispenser in accordance with the invention, with a covering lid being removed to show the interior of the holder/dispenser.

In brief, the invention may be described as a storage container/dispenser that is sized to sit in a relatively unobtrusive manner in the vicinity of a coffee urn or other dispenser for one or more beverages. The function of the holder/dispenser is to store/hold small packets of cream at a temperature that is substantially less than room temperature (e.g., 40 degrees Fahrenheit) for an extended period of time (e.g., several hours). To simplify the description, it will be assumed that beverage to be served is hot coffee, and the accompanying thing to be served with the coffee is a spoilable diary product like cream—either "real" or artificial. The apparatus is provided with a plurality of vertically oriented containers (e.g., tubes) that are open at their tops and bottoms; the top of each tube is open to receive the packets that are to be dispensed, and each bottom opening is sized and oriented for dispensing the packets on an as-needed basis. The containers are distributed uniformly around, and in heat-exchanging contact with, the periphery of a central cavity in the apparatus. The central cavity is open at its top, so that it can receive and hold a heat-exchange package (e.g., a eutectic unit) that can be manually inserted into the cavity on an as-required basis. Depending on the amount of cooling that is desired or necessary, and depending on the work schedule of the persons who are in charge of the apparatus, a typical eutectic unit can be removed and replaced with a fresh unit every eight to ten hours or so. As a part of the job description of an employee of a convenience store, it can be required that a freshly chilled eutectic unit be substituted for a "used" (and now somewhat warmer) eutectic unit at the beginning of each eight-hour work shift. By having at least two eutectic units that are the same size and shape, one unit can be kept in a freezer getting chilled while the second unit is working in the apparatus to keep the creamer packets from getting so warm that they might have a tendency to spoil. An attendant need only substitute one unit for the other when the designated amount of time has passed.

For convenience, the apparatus is arranged in the general shape of a cylinder about eight inches in diameter and about fifteen inches tall. Such an apparatus is small enough to fit on a serving counter without taking up too much space, but large enough to hold a supply of cream packets that will normally be adequate to serve customers' needs for several minutes—or even hours. When the apparatus has a transparent cover, it is possible to make a quick visual evaluation of the quantity of packets in the apparatus. Expressed in other words, a person can practically take inventory of the available packets by merely walking past the apparatus and glancing at it. As long as the supply of packets is adequate, an employee can wait until a slack time in a work shift to resupply the apparatus with a fresh number of packets.

By making the cover transparent, an opportunity is created for placing a sheet of paper inside the cover, where the paper will be protected from dirt or accidental splashes of liquid, etc. On the outwardly facing surface of the paper, there can be printed advertisements for special coffee flavors, or promotional combinations with other food items, or special sale prices, etc. Alternatively, an advertisement can be affixed to the outside of the apparatus.

DETAILED DESCRIPTION OF A PREFERRED EMBODIMENT OF THE INVENTION

For simplicity, the invention will be initially described in the form of an embodiment for dispensing cream packets, although those skilled in the art will recognize that minor adjustments in the size of the internal compartments would make the device suitable for other small containers. Referring to FIG. 1, a preferred embodiment of the invention—a cream holder/dispenser 10—is shown which has nine vertical tubular holders 12 for cream packets 14 arranged in a circle around a central tube or core 16. (The cream packets 14 are shown in broken line.) To foster both durability and cleanliness, the tubular holders 12 and the central tube 16 are made of stainless steel, and they are welded to one another to rigidly fix their relative positions. Also welded to the central tube 16 are three radially extending webs 18; the distal edges of the webs are used to centrally position a cover in the form of a large section of clear acrylic tubing 20, so that the cover will be concentric with the central tube 16.

Figure 2:
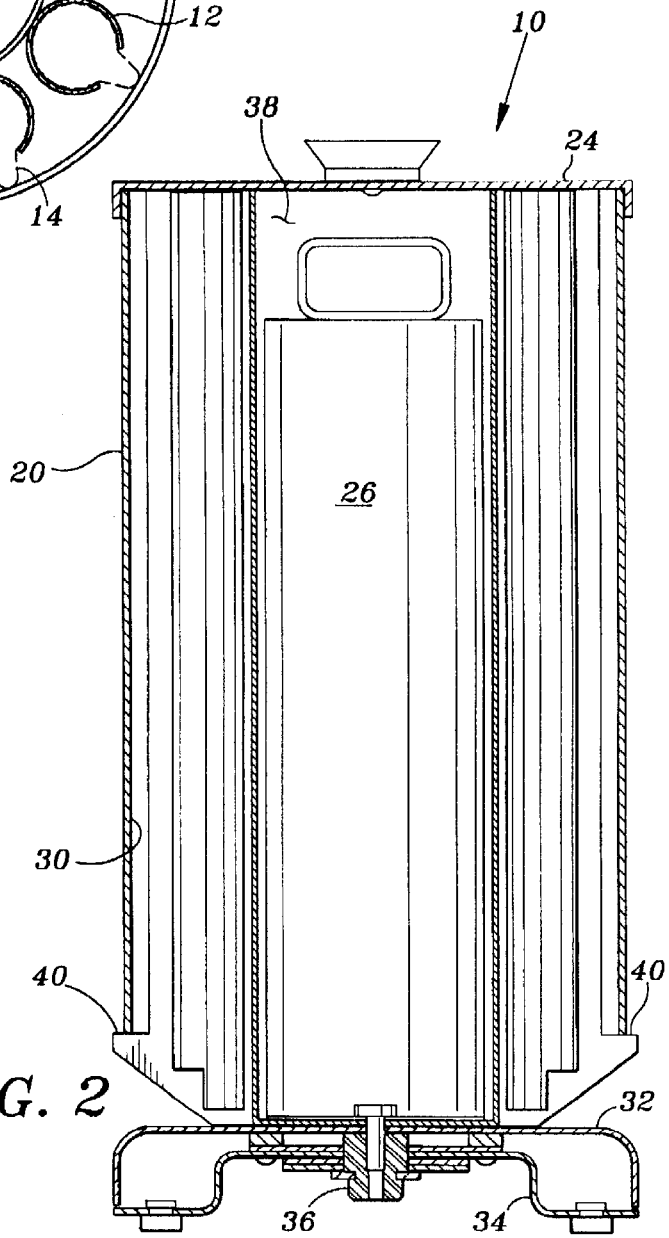
FIG. 2 is a cross-sectional view taken vertically through the holder/dispenser, and showing a central container that is designed to hold a eutectic material to keep the holder/dispenser cool enough to preserve the freshness of cream for hours.

As indicated in FIG. 2, the transparent cover 20 has a diameter (e.g., about 8 inches) and a height (approximately 15 inches) that essentially defines the shape and size of a preferred holder/dispenser 10. When the cover 20 is in the form of a plastic tube, it will typically have a thickness of about ⅛th inch, so it will be substantially rigid—and it can be readily handled for cleaning, etc. To protect a plastic tube 20 against being internally scratched during any vertical movement with respect to the centering webs 18, U-shaped rubber channels 22 are placed on the distal edges of the webs. The tube 20 is slightly shorter than the total height of the dispenser 10, so that individual cream packets can be dispensed by pulling them radially outward from under the tube's bottom edge when the tube is in its installed position. In view of the fact that there may be two persons who are wanting to obtain a packet from the holder/dispenser 10 at the same time, it is preferred that all of the tubes 20 be open at the bottom for simultaneously dispensing their contents. So as long as there is physical space around the holder/dispenser to accommodate two or more people, each of the people may have simultaneous access to the respective packets that happen to be closest at that particular time.

A removable cap 24 normally sits on top of the dispenser 10 when the dispenser is installed for use on top of a self-service counter or the like. The cap 24 is removable to facilitate convenience in filling the individual channels in which the cream packets are stored until they are removed for use. A removable cap also fosters cleanliness in the holder/dispenser 10, in that a water hose can be used to send a jet of cleaning water straight through the apparatus 10, from top to bottom. Temporary removal of the cap 24 is also involved in removing and replacing a sealed heat-exchange unit 26 (also called a eutectic unit or a "chill" unit) that rests centrally of the dispenser 10. Such a sealed unit 26 can be cooled to below 32 degrees Fahrenheit (i.e., solidly frozen) in a freezer in the back room of the premises, and then inserted into a dispenser 10 just before the dispenser is brought into a public area for use. Or if the dispenser is already in place, the unit 26 can simply be brought to the dispenser and substituted for a similar unit that's already inside the dispenser.

The eutectic unit 26 will normally keep about 40 to 80 cream packets cool for several hours. And, as is typical with such eutectic units, they can be repeatedly cycled, that is, the units can be frozen, used at room temperature, refrozen, reused, etc. An exemplary eutectic material is sold by the Universal Chemical Division of R.M. Hollingshead Corporation under the trademark ZER-O-ICE; this material is normally packaged in small containers (about the size of a quart of milk) and is intended for use in portable beverage coolers, etc. The preferred heat-exchange material is sold by M-C Industries, Inc. of Topeka, Kans. under the trademark Xygel Gel Packs. The Xygel material is described by the manufacturer as a crosslinked modified acrylic polymer. After being frozen for several hours, a heat-exchange unit 26 can be expected to experience a temperature rise of less than five degrees Fahrenheit over a period of eight hours when the unit has been placed in a room at what is commonly called normal room temperature. The preferred heat-exchange unit for the apparatus 10 weighs about five pounds (when the container is made of stainless steel), so it can be easily handled by persons who are likely to be working in a convenience store or restaurant, etc. A plastic container for the heat-exchange gel (about two quarts) would likely reduce the weight of an eutectic unit by about a pound. The total weight of the apparatus will likely be about 20 pounds when stainless steel is the primary structural component. But additional mass could be added at the bottom of the apparatus, if desired.

By using portable eutectic units 26 and portable dispensers 10, there is no need to have electric power for refrigeration in an area where a customer could misuse the dispenser or accidentally get shocked by doing something that creates an electrical hazard. Too, there is no mess to clean up because there is no melted ice that can spill on a counter or a floor. When it is essentially rigid, the outer tube 20 also functions as a "sneeze guard" to isolate the stored cream packets from general contamination; and when transparent, it also functions as a holder for advertisements that a merchant might want to place immediately in front of a coffee customer. For example, if the manager of a cafeteria or convenience store wants to promote a new flavor of coffee, an advertisement can be placed on the cover/tube 20, where it will be near the coffee dispenser. If desired, a long sheet of paper 30 can be curled or bent into the shape of a cylinder and inserted into the tube 20, where the paper will rest immediately next to the inside surface of the tube—with the advertising text on the paper facing outwardly. And if a special price is being offered on a certain beverage, the merchant can easily notify potential customers by the simple act of printing a new paper and inserting it into the tube 20 in such a way that the paper can be seen through the transparent wall of the tube. Alternatively, the advertisement can be printed on a material that has "electrostatic" properties so that it will adhere to the outside of the cover/tube 20.

Another way of considering the combination of an apparatus 10 and any printed matter is to think of them as constituting a miniature "billboard"; and when a printed message is promoting the consumption of a particular beverage, the apparatus can be placed in front of customers in close proximity to a dispenser for the beverage that a customer is being urged to buy. An apparatus 10 with a transparent cover 20 can also be used, say, in a company cafeteria to present a variety of safety messages to employees, or it may be used to present messages equivalent to so-called public service announcements—like "Don't forget to vote on Tuesday."

Figures 3, 4:
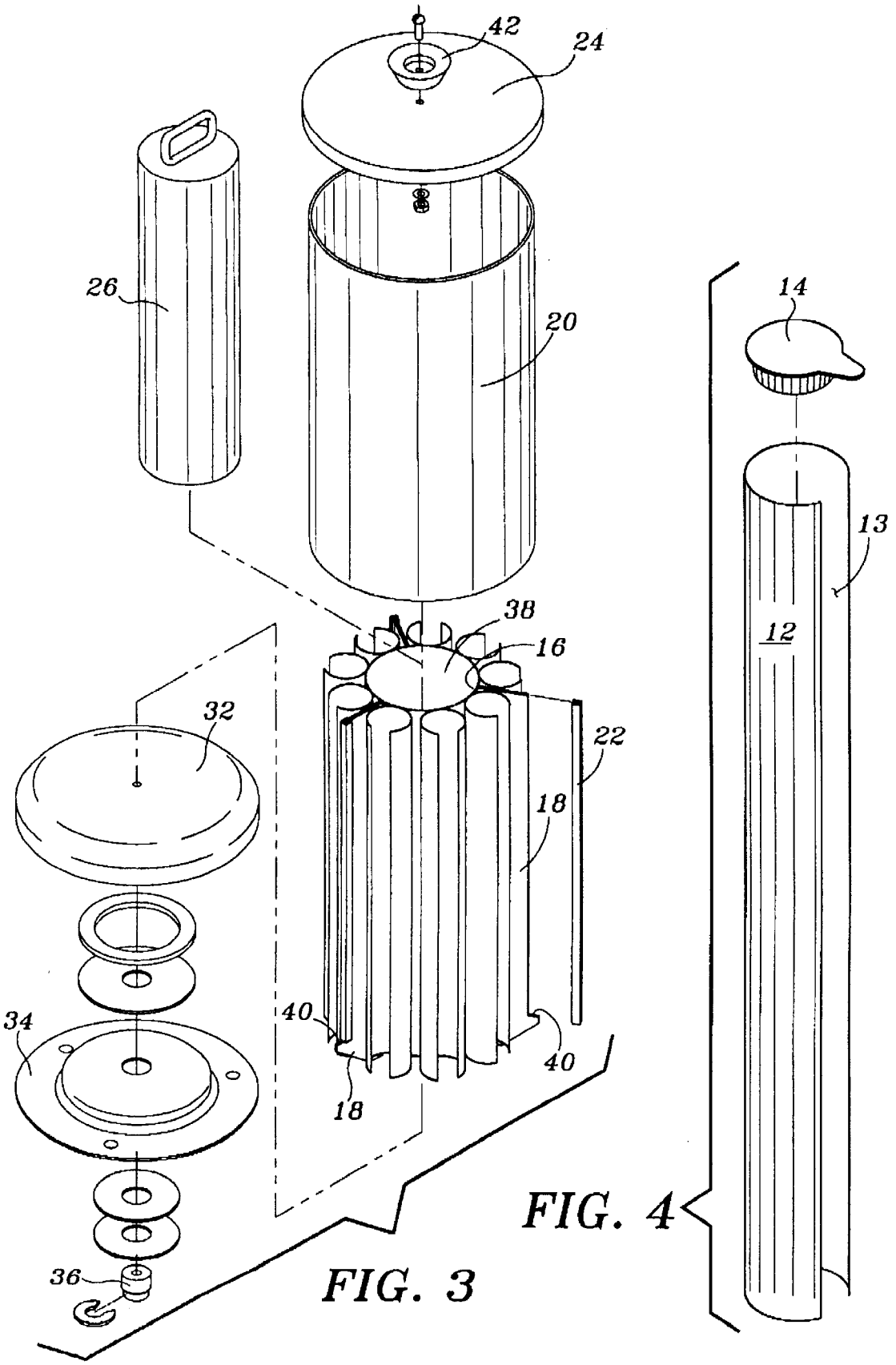
FIG. 3 is an exploded perspective view of the holder/dispenser shown in FIGS. 1 and 2.
FIG. 4 is a perspective view of a single storage tube in which a plurality of cream packets may be held adjacent a eutectic container.

Referring next to FIG. 3, which is a perspective view of the preferred embodiment of the invention, the major parts of the apparatus 10 are shown in an exploded manner. Starting from the bottom, a base 32 is adapted to rest on a generally horizontal plane—such as a table or a counter top in a restaurant or the like. A housing in the form of the core 16 is centrally fixed to and rotatably supported above the base 32, so that the housing may be selectively rotated by consumers. However, the housing 16 does not freely rotate—in the manner that blades of a windmill might rotate when they are subjected to a 20-mile per hour wind; instead, a lock nut 36 imposes sufficient drag on the housing so that it rotates slowly in response to manual pressure from a customer. (This serves to prevent unsupervised children from playing with the apparatus—in order to see how far across the room they might sling a creamer packet by vigorously spinning the apparatus.) A significant space between the base 32 and a sub-base 34 can optionally hold a mass of heavy material, e.g., a ring of cast iron, to introduce more stability to the apparatus—if a safety engineer thinks it needs more mass near its bottom. That is, if someone opines that the apparatus needs to be more "bottom heavy," such a desire could be easily satisfied by introduction of an out-of-sight weight below the base. The housing 16 has a cavity 38 that is sized and shaped to receive the eutectic unit 26. Both the housing 16 and the cavity 38 are shown as cylindrical, but other shapes (e.g., a square) might serve as well, provided that manufacturing costs are not too high.

The heat-exchange unit 26 is shown at the left of FIG. 3, where it might be positioned if it had just been lifted out of the housing 16. And to help keep the creamer packets cool, there are shown nine tubular holders 12 for the creamer packets, said holders being affixed to the periphery of the housing. The holders 12, like the housing 16, are preferably made of stainless steel, which is beneficial because of several reasons. First, stainless steel is durable and has good heat-transfer properties; it is commonly used in the food-handling industry, and no special instructions are likely to be required for the persons who will be handling the apparatus. Too, any regulatory person (e.g., a city food service inspector) will almost surely appreciate that the apparatus 10 can be easily cleaned with soap and water, and it will not pose a health risk when used by the public in its intended manner. It might also be said that the National Sanitation Federation International has a bias in favor of things made out of stainless steel, although aluminum can also be certified for food service use—if the aluminum is powder coated with an approved material.

Referring additionally to FIG. 4, a single creamer packet is shown immediately above one of the storage compartments in the form of a tubular holder 12. A slot 13 about ½ or ⅝th inch wide extends vertically from the top of the holder to its bottom, allowing the tongue of a typical creamer packet 14 to fit within the slot and provide for an orderly, controlled descent of upper packets—by gravity—as lower ones are removed by customers and consumed. If the creamer packet (or some other product) is not sized so that it closely matches the interior of a tube 12, a plastic insert can be provided to take up any excess space in the tube; perforations in such a plastic insert can help ensure that the desired heat-transfer properties are not compromised by any insulating characteristics of the plastic.

Referring still to FIG. 3, there are three structural webs 18 that are fixed to the central tube 16 where they extend outwardly in a radial manner. Secured to the distal edges of the webs are the U-shaped rubber bumpers 22; these non-rigid bumpers serve as non-scratch cushions and guides when a cover 20 is to be moved (vertically) with respect to a static base 32. Near the bottom of the three webs 18 are three protruding lips 40 that extend outwardly (beyond the locus of all elements of the holders 12) by about ¼th inch. These three lips 40 serve to vertically support the cover 20 with respect to the base 32, and their height also defines the vertical gaps (about 1.75 inches) through which the creamer packets are dispensed. At the top of the apparatus 10 is the removable cap 24 and a plastic knob 42 that facilitates manual grabbing and lifting of the cap. When the cap 24 has been lifted, the cavity 38 is fully accessible and the present eutectic unit 26 can be removed and another—colder—one put in its place.

Figure 7:
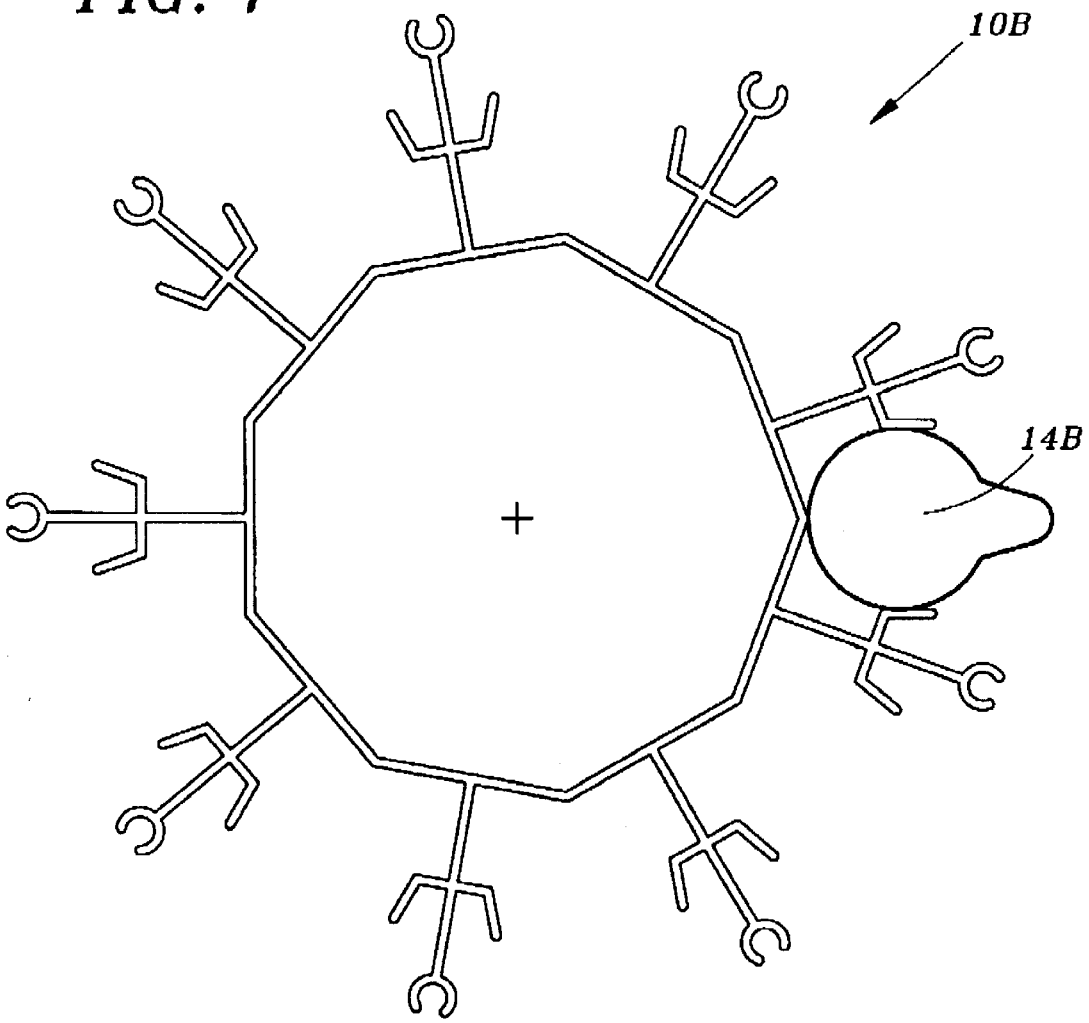
FIG. 7 is a top plan view of an alternative embodiment of the invention, wherein a set of "trees" have been assembled to form a circular arrangement of containers for creamer packets.

Referring next to FIG. 5, a component for an alternative embodiment of the invention is shown. FIG. 5 shows a top view of an extruded element 50 which can be made of aluminum or a high-strength plastic such as ABS. A single element 50, cut to a length of about 15 inches, would likely be of no practical use to anyone; but three of these elements could be arranged, edge to edge, to form a circle, as shown in FIG. 6. The male connector 52 of a particular element can be slipped longitudinally into the female recess 54 of an adjacent element, thereby forming an essentially rigid assembly 10A. When assembled, three elements 50 define a closed body with nine vertically oriented tubes in which packets may be stored and through which they may be dispersed upon demand. The connected elements 50 shown in FIG. 6 could be further rigidified by inserting a thin cylindrical sleeve into the center of the connected elements, and binding them all together with an adhesive or a fastener or the like. An alternative embodiment of an apparatus 10B is shown in FIG. 7 wherein a set of "trees" have been assembled to form a peripheral arrangement of containers for creamer packets. A single packet 14B has been shown to illustrate how a plurality of such packets would fit between adjacent "trees." For simplicity, the male/female connections between adjacent elements has been omitted from this drawing; but this embodiment can also be fabricated from extrusions that are joined together by engaging their respective edges—like the one shown in FIG. 6.

While only the preferred embodiment and a couple of alternative embodiments have been disclosed herein, those skilled in the art will surely appreciate that variations in the designs and elements could be made without departing from the spirit of the invention. And while the apparatus has been described as being primarily useful for keeping cream packets cool, it obviously could be used for other liquids, creams, gels or solids that are adapted to be similarly packaged. Hence, it should be understood that the scope of the invention should be measured only by the breadth of the claims appended hereto.

What is claimed is:

1. A portable apparatus for storing small packets of perishable material in such a way as to extend the storage life of the material, said perishable material being intended for human consumption, and the apparatus being intended to store the material at a temperature that is significantly below room temperature, and the apparatus also being intended to permit the manual removal of individual ones of the stored packets at a time when they are to be consumed, comprising:

a) a base adapted to rest in a generally horizontal plane;

b) a housing fixed to and supported above the base, and there being a cavity in the housing that is sized and shaped to receive and hold a portable heat-exchange device;

c) a heat-exchange device including a sealed container that is substantially filled with a medium that can be repeatedly cycled between room temperature and a temperature that is below 32 degrees Fahrenheit;

d) means for holding a plurality of small packets of perishable material in heat-exchanging relationship with the exterior of the housing, said means including a plurality of vertically oriented tubes, and the tubes having both open tops and open bottoms, whereby a heat-exchange device that is present within the housing can function to keep the packets at a temperature that is significantly below room temperature; and e) a non-pervious cover mounted over the combination of the housing and any packets of perishable material that are present in the housing, whereby any packets that are stored in the housing may be isolated from contact with persons and things until such time as the packets are deliberately removed from the apparatus.

2. A portable apparatus for storing small packets of perishable material in such a way as to extend the storage life of the material, said perishable material being intended for human consumption, and the apparatus being intended to store the material at a temperature that is significantly below room temperature, and the apparatus also being intended to permit the manual removal of individual ones of the stored packets at a time when they are to be consumed, comprising:

a) a base adapted to rest in a generally horizontal plane;

b) a housing fixed to and supported above the base, and there being a cavity in the housing that is sized and shaped to receive and hold a portable heat-exchange device;

c) a heat-exchange device including a sealed container that is substantially filled with a medium that can be repeatedly cycled between room temperature and a temperature that is below 32 degrees Fahrenheit;

d) means for holding a plurality of small packets of perishable material in heat-exchanging relationship with the exterior of the housing, whereby a heat-exchange device that is present within the housing can function to keep the packets at a temperature that is significantly below room temperature;

e) a non-pervious cover mounted over the combination of the housing and any packets of perishable material that are present in the housing, whereby any packets that are stored in the housing may be isolated from contact with persons and things until such time as the packets are deliberately removed from the apparatus; and f) the apparatus having a top and a bottom, and further including a heavy weight mounted to the base and carried near the bottom of the apparatus, and the mass of the heavy weight being on the order of the combined mass of the housing and the cover and the means for holding a plurality of packets, such that the apparatus may be aptly characterized as bottom heavy, whereby the apparatus will be relatively stable in use because of the concentration of mass near the bottom of the apparatus.

3. A portable apparatus for storing small packets of perishable material in such a way as to extend the storage life of the material, said perishable material being intended for human consumption, and the apparatus being intended to store the material at a temperature that is significantly below room temperature, and the apparatus also being intended to permit the manual removal of individual ones of the stored packets at a time when they are to be consumed, comprising;

a) a base adapted to rest in a generally horizontal plane;

b) a housing fixed to and supported above the base, and there being a cavity in the housing that is sized and shaped to receive and hold a portable heat-exchange device;

c) a heat-exchange device including a sealed container that is substantially filled with a medium that can be repeatedly cycled between room temperature and a temperature that is below 32 degrees Fahrenheit;

d) means for holding a plurality of small packets of perishable material in heat-exchanging relationship with the exterior of the housing, whereby a heat-exchange device that is present within the housing can function to keep the packets at a temperature that is significantly below room temperature;

e) a non-pervious cover mounted over the combination of the housing and any packets of perishable material that are present in the housing, whereby any packets that are stored in the housing may be isolated from contact with persons and things until such time as the packets are deliberately removed from the apparatus; and f) the housing and the cover being selectively rotatable with respect to the base when it is static.

4. A portable apparatus for storing small packets of perishable material in such a way as to extend the storage life of the material, said perishable material being intended for human consumption, and the apparatus being intended to store the material at a temperature that is significantly below room temperature, and the apparatus also being intended to permit the manual removal of individual ones of the stored packets at a time when they are to be consumed, comprising:

a) a base adapted to rest in a generally horizontal plane;

b) a housing fixed to and supported above the base, and there being a cavity in the housing that is sized and shaped to receive and hold a portable heat-exchange device;

c) a heat-exchange device including a sealed container that is substantially filled with a medium that can be repeatedly cycled between room temperature and a temperature that is below 32 degrees Fahrenheit;

d) means for holding a plurality of small packets of perishable material in heat-exchanging relationship with the exterior of the housing, whereby a heat-exchange device that is present within the housing can function to keep the packets at a temperature that is significantly below room temperature;

e) a non-pervious cover mounted over the combination of the housing and any packets of perishable material that are present in the housing, whereby any packets that are stored in the housing may be isolated from contact with persons and things until such time as the packets are deliberately removed from the apparatus; and f) a plurality of non-rigid cushions that are located so as to guide the cover as it is being placed over the housing, whereby there will be a reduced likelihood of scratching the interior of the cover as a result of movement of the cover with respect to the housing.

* * * * *